United States Patent [19]

George

[11] 4,037,610

[45] July 26, 1977

[54] SMOKING SYSTEM

[76] Inventor: Philip F. George, 2 Dartmouth St., Worcester, Mass. 01604

[21] Appl. No.: 688,622

[22] Filed: May 21, 1976

[51] Int. Cl.[2] ..... A24F 3/02; A24F 9/02

[52] U.S. Cl. ..... 131/184 A; 131/247

[58] Field of Search ..... 131/184, 184 A, 247, 131/243, 177

[56] References Cited

U.S. PATENT DOCUMENTS

| | | | |
|---|---|---|---|
| 1,019,028 | 3/1912 | Dodge | 131/247 X |
| 2,460,937 | 2/1949 | Kaufman | 131/247 X |

*Primary Examiner*—Stephen C. Pellegrino

*Attorney, Agent, or Firm*—Norman S. Blodgett; Gerry A. Blodgett

[57] ABSTRACT

Smoking system including a tamper with a tubular portion for compressing the tobacco in a pipe around the periphery of the bowl.

7 Claims, 2 Drawing Figures

SMOKING SYSTEM

BACKGROUND OF THE INVENTION

The smoking of tobacco in a pipe is a delightful pastime and is preferable in many ways to other means of smoking tobacco. One of the advantages of pipe smoking is that is usually smells better than the smoke from cigarettes and cigars. If the pipe is filled and lit properly, the smoking cycle should last for a considerably longer time than in the case of a cigarette; also, it is possible to smoke a pipe without the use of the hands, so that pipe smoking can take place while performing other tasks. However, the smoking of a pipe is not without its drawbacks. Pipe tobacco has a tendency to be coarse and non-homogeneous, so that it is sometimes difficult to keep a pipe in lighted condition. There is a tendency in smoking a pipe for saliva to work its way down the stem of the pipe and into the bowl. When this saliva takes part in the combustion process, the smoke not only has an unpleasant "bite" , but the smell of the smoke which drips into the air is also somewhat unpleasant. It has been suggested that some of the difficulties experienced in pipe smoking can be removed by tamping or compressing the tobacco, and flat, round tampers have been provided in the past for this purpose, the tamper sometimes being combined with other pipe smoking tools. This process of compressing the entire body of tobacco in the pipe has not been successful in removing the diffficulties and, as a matter of fact, compressing the entire load of tobacco makes the pipe difficult to draw, since the compression of the tobacco in this way causes it to present more resistance to the downward flow of air. These and other difficulties experienced with the prior art devices have been obviated in a novel manner by the present invention.

It is, therefore, an outstanding object of the invention to provide a smoking system which results in a sweeter smoke and a longer lasting burning cycle.

Another object of this invention is the provision of a smoking system in which any saliva that accumulates on a pipe bowl surface does not take part in the combustion process.

A further object of the present invention is the provision of a smoking system for pipes in which the advantages of compressing the tobacco are obtained without an attendant reduction in air flow capacity.

It is another object of the present invention to provide a pipe smoking system in which the bowl of the pipe does not become overheated, in which the burning tobacco is inslated from the tars which have accumulated in the inner surface of the bowl, and in which deterioration of the inner surface of the pipe bowl is substantially reduced.

A still further object of the invention is the provision of a pipe smoking system in which the smoke results only from the combustion of tobacco and not from the burning of accumulated tars and of ash which contains undesirable chemicals.

It is a further object of the invention to provide a pipe smoking system which is less dangerous to the health of the smoker, because undesirable chemicals are not present in the smoke.

It is still further object of the present invention to provide a pipe smoking system in which the area of burning tobacco is smaller than in a conventional system, so that a bowl which is filled with tobacco takes longer to burn and the smoke is cooler.

Another object of the invention is the provision of a pipe smoking system in which burning takes place through the center of the body of tobacco in the bowl, so that burning does not burn only down one side of the bowl, so that the smoke does not contain burned ash, wood or saliva from the surface of the bowl, and so that ash and tar do not coat the bowl.

With these and other objects in view, as will be apparent to those skilled in the art, the invention residesin the combination of parts set forth in the specification and covered by the claims appended hereto.

SUMMARY OF THE INVENTION

In general, the invention consists of a smoking system for use in a pipe having a bowl adapted to receive tobacco, the bowl having a substantially cylindrical inner surface. A tamper is provided which has a holding portion and which has a tubular portion extending from the holding portion. The tubular portion has an outer surface adpated to fit snugly into the inner surface of the bowl and the tubular portion also has a relatively thin wall, so that the tamper acts to compress the tobacco only adjacent the said inner surface of the bowl.

More specifically, a disc is provided to rest in the bowl to support the tobacco, the disc having a central aperture. In the preferred embodiment, the disc and the tamper are made of briar.

BRIEF DESCRIPTION OF THE DRAWINGS

The character of the invention, however, may be best understood by reference to one of its structural forms, illustrated by the accompanying drawings, in which.

DESCRIPTION OF THE PREFERRED EMBODIMENT

Figure 1:
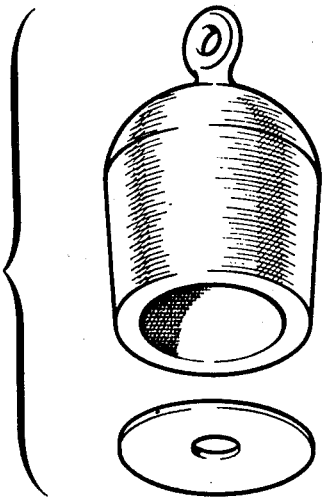
FIG. 1 is a perspective exploded view of a smoking system incorporating the principles of the present invention.

Referring first to FIG. 1, wherein are best shown the general features of the invention, the smoking system, indicated generally by the reference numeral 10, is shown as consisting of a tamper 11 and a disc 19. The tamper has a holding portion 12 from which extends a tubular portion 13. The tubular portion has an outer surface 14 adapted to fit snugly in the bowl of a pipe. The tubular portion also has an inner surface 23 of roughly cylindrical form, thus defining between the inner and outer surface a thin wall whose lower edge serves to compress tobacco in the pipe bowl adjacent the inner surface of the bowl.

The disc 19 is shown as having a circular outer periphery 21 which can fit snugly into the bottom of the bowl of the pipe and is also provided with a generally-central aperture 22 for the flow of air.

Figure 2:
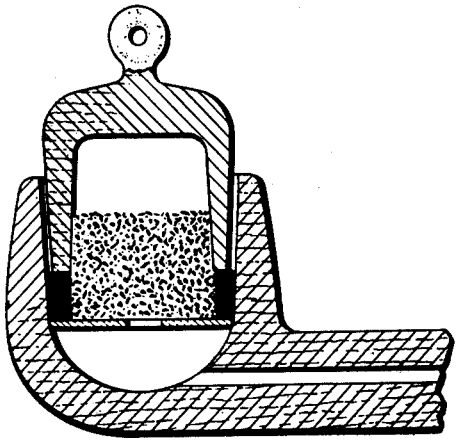
FIG. 2 is a vertical sectional view of the smoking system shown in use with a pipe and tobacco.

Referring next to FIG. 2, the smoking system 10 is shown in use with a pipe 16 having a bowl 15 and the usual stem. The pipe is provided with an inner surface 18 containing a body 17 of tobacco. In the preferred embodiment, the tamper 11 and the disc 19 are formed of briar and the handle of the tamper may be sterling slver. The holding portion 12 of the tamper is provided with an integral ring 24 which is locted centrally thereof. As is evident in this figure of the drawings, the inner surface 23 and the outer surface 14 of the tamper are slightly tapered to form a relatively thick wall adjacent the holding portion 12 and a relatively thin wall at the edge which contacts tobacco. In the preferred embodiment, the inner surface 18 of the bowl of the pipe is similarly tapered to match the taper of the outside of the tamper.

The operation and the advantages of the present invention will be readily understood in view of the above description. With the disc 19 residing in the bottom of the bowl 15 of the pipe 16, the bowl is filled almost to the top with a body 17 of tobacco. The tamper 11 is placed in the bowl of the pipe with the outer surface 14 of the tubular portion lying adjacent the inner surface 18 of the bowl. The lower edge of the tubular portion rests against the body 17 of the tobacco. The user grasps the holding portion 12 of the tamper by means of the ring 24 and presses downwardly. The lower edge of the tubular portion compresses the tobacco adjacent the inner surface 18 of the bowl, while allowing the remainder of the body 17 in the central portion to remain relatively undisturbed. If the size and taper of the outer surface 14 of the tamper and the inner surface of the bowl are selected properly, the tobacco will be exactly suitably compressed when the surface 14 engages the surface 18 and the tamper will go into the bowl no further.

The tamper is then removed and the central portion of the body of tobacco is lit, while the user draws air through the pipe in the usual way. Since the burning of the tobacco depends on a flow of air through the body of tobacco, it can be seen that the central undistrubed portion will burn in the normal way, but that any burning that might otherwise take place in the periphery adjacent the surface 18 of the bowl will be inhibited. This means that, not only will no tars and the like accumulate on the surface of the bowl, but it also means that, if a pipe is used only with the present smoking system from the time that it is new, there never will be an accumulation of such materials. This, in turn, means that the heat of the burning tobacco will not regenerate or redistill such undesirable materials. It also means that there will be no burning of the material of the pipe itself. This latter advantage, of course, means that the pipe will last longer and not wear out. The compression of the outer portion of the body of tobacco also means that the problem of non-symmetrical burning does not take place. In the past, even through the center of the tobacco was lit, nevertheless there could be a tendency (because of the non-homogeneous nature of the tobacco) for the lighted portion to shift to one side of the bowl and sometimes work its way down the wall of the bowl, rather than stay in the center of the body of tobacco. In the present case a tendency for the burning portion to feed laterally is removed, since the burning tobacco soon encounters the tough compressed portion of the tobacco body adjacent the bowl. This also means that the burning takes place bot only centrally of the bowl, but over a much more restricted area, so that the smoker is not faced with the former problem of the entire area of the body of tobacco burning at the same time. Thus, a particular "load" of tobacco will burn longer and more slowly. The use of the disc 19 to act as a platform (combined with the compression of the outer layer of tobacco) serves to prevent saliva from entering the body of tobacco to produce an unpleasant smoke. The saliva not only tends to remain in the bottom of the bowl under disc, but also any amount of saliva which tends to move up the wall of the bowl encounters the compressed tobacco adjacent the wall of the bowl and is prevented from entering into the main combustion in two ways. First of all, it soaks into the compressed portion of the tobacco which, as has been stated does not enter into the burning process in the first place; secondly, its movement through that body is inhibited because the tobacco is compressed and the capillary travel of the saliva is inhibited. Presumably, the saliva-soaked tobacco is removed after the smoke is through.

Another advantage of the present invention is the absence of the dual effect of the accumulation of ash and tar on the inside of the bowl and of the presence of saliva. In the ordinary smoking pipe, the saliva soaks into the body of ash and remains there and is reburned and re-evaporated along with the toxic and unpleasant organic materials in the saliva. In the present invention, since there is no ash accumulation, there is no regeneration of saliva. The disc maintains the body of tobacco free of the bottom of the bowl, so that it is not soaked in any saliva that may be present; this means that the tobacco in the bottom of the bowl that would normally be wasted (since it is simply too unpleasant to be burned) is not wasted. In addition, the layer of compressed tobacco acts as an insulation that prevents damgage by burning of the inside surface of the bowl.

It is obvious that minor changes may be made in the form and construction of the invention without departing from the material spirit thereof. It is not, however desired to confine the invention to the exact form herein shown and described, but it is desired to include all such as properly come within the scope claimed.

The invention having been thus described, what is claimed as new and desired to secure by Letters Patent is:

1. Smoking system, comprising a. a pipe havng a bowl adapted to receive tobacco, the bowl having a substantially cylindrical inner surface, and b. a tamper having a holding portion and having a tubular portion extending from the holding portion, the tubular portion having an outer surface adapted to fit snugly into the said inner surface of the bowl, the tubular portion having a relatively thin wall, so that the tamper acts to compress the tobacco only adjacent the said inner surface of the bowl.

2. Smoking system as recited in claim 2, wherein the inner and outer surfaces of the tubular portion are slightly tapered from a relatively thick wall adjacent the holding portion to a relatively thin wall at the edge remote from the holding portion.

3. Smoking system as recited in claim 1, wherein the holding portion is provided with an integral ring, the ring being located centrally and extending in the opposite direction to the tubular portion.

4. Smoking system as recited in claim 2, wherein a disk is provided to rest in the bowl to support the tobacco, the disk having an outer perihpery shaped to fit snugly in the lower portion of the inner surface of the bowl and having a generally central aperture.

5. Smoking system as recited in claim 4, wherein the tamper and the disk are both formed of briar.

6. Smoking system, comprising a. a pipe having a bowl adapted to receive tobacco, the bowl having a substantially cylindrical inner surface, and b. a tamper formed of briar, the tamper having a holding portion and having a tubular portion extending from the holding portion, the tubular portion having an outer surface adapted to fit snugly into the said inner surface of the bowl, the tubular portion having a relatively thin wall, so that the tamper acts to compress the tobacco only adjacent the said inner surface of the bowl, the inner and outer surfaces of the tubular portion being slightly tapered from a relatively thick wall adjacent the holding portion to a relaively thin wall at the edge remote from the holding portion, the holding portion being provided with an integral ring, the ring being located centrally and extending in the opposite direction to the tubular portion.

7. Smoking system as recited in claim 6, wherein a disk is provided to rest in the bowl to support the tobacco, the disk having an outer periphery shaped to fit snugly in the lower portion of the inner surface of the bowl and having a generally central aperture.

* * * * *